4,323,901

United States Patent [19]

De Wames et al.

[11] 4,323,901

[45] Apr. 6, 1982

[54] MONOLITHIC, VOLTAGE CONTROLLED, PHASED ARRAY

[75] Inventors: Roger E. De Wames; William F. Hall; William W. Ho; Teong C. Lim, all of Thousand Oaks, Calif.

[73] Assignee: Rockwell International Corporation, El Segundo, Calif.

[21] Appl. No.: 122,331

[22] Filed: Feb. 19, 1980

[51] Int. Cl.[3] ..... H01Q 19/06

[52] U.S. Cl. ..... 343/754; 343/909

[58] Field of Search ..... 343/754, 854, 909, 911 R, 343/756

[56] References Cited

U.S. PATENT DOCUMENTS

| | | | |
|---|---|---|---|
| 2,921,308 | 1/1960 | Hansen et al. | 343/754 |
| 2,959,783 | 11/1960 | Iams | 343/754 |
| 3,067,420 | 12/1962 | Jones et al. | 343/754 |
| 3,631,501 | 12/1971 | Buscher | 343/754 |
| 3,904,270 | 2/1974 | Cheo | 350/96 UG |
| 3,924,931 | 12/1975 | Cheo | 350/160 R |
| 3,959,794 | 5/1976 | Chrepta et al. | 343/754 |
| 4,090,204 | 5/1978 | Farhat | 343/754 |
| 4,128,300 | 12/1978 | Stotts et al. | 350/96.14 |

OTHER PUBLICATIONS

Klein et al; Phase Shifting at 94 GHz Using Bulk Crystals, IEEE Cat. No. 79, CH1384-7MTT, 1979, pp. 280, 281.

Boyd et al; Physical Review Letters, vol. 26, No. 7, Feb. 2, 1971, pp. 387-390.

Boyd & Pollack, Physical Review B, vol. 7, No. 12, Jun. 15, 1973, pp. 5345-5359.

Bystrov et al; Electro-Optic Materials in the Submillimeter Range, 41 Izv, Akad. Sci. Ser. Fiz. 485, 1977, pp. 23-29.

Bystrov et al; Ferro Electrics, vol. 21, p. 359, 1978 Abstract Only.

Turik et al; Dielectric Spectrum of $BaTiO_3$ Single Crystals. Phys. Stat. Sol.(b) 95, 585 (1979), pp. 585-592.

Turik et al., High Freq. Dispersion of the Permittivity of c-Domain $BaTiO_3$, Sov. Phys. Solid State (1977), pp. 1644-1646.

Turik et al., On the Nature of Dielectric Permittivity of $PbTiO_3$ Crystals Phys. Stat. Sol. (b) 94 (1979), pp. 525-528.

*Primary Examiner*—Eli Lieberman

*Attorney, Agent, or Firm*—H. Fredrick Hamann; Craig O. Malin; John J. Deinken

[57] ABSTRACT

Disclosed is a phased array for steering an electromagnetic wave, which includes a first layer of active material, including parallel first inner and outer surfaces, and a second layer of active material, including parallel second inner and outer surfaces which are also parallel to the first inner and outer surfaces, the second layer being adjacent to the first layer. An electrically conductive ground plane of indium tin oxide is disposed between the first and second layers and in electrical contact with the first and second inner surfaces. A first series of spaced parallel electrodes, each of the electrodes being in the form of a thin strip of indium tin oxide, is deposited on the first outer surface, while a second series of spaced parallel electrodes, each of these electrodes also being in the form of a thin strip of indium tin oxide, is similarly deposited on the second outer surface but is orthogonal to the first series of electrodes. A first anti-reflective coating may be deposited on the first outer surface, with a second antireflective coating deposited on the second outer surface.

19 Claims, 4 Drawing Figures

MONOLITHIC, VOLTAGE CONTROLLED, PHASED ARRAY

BACKGROUND OF THE INVENTION

This invention relates to the use of electromagnetic waves and, more particularly, relates to devices for changing the propagation direction of an electromagnetic wave.

In the years since the development of radar systems for military applications during World War II, radio ranging systems have undergone extensive refinement and have been employed in many different environments, both military and civilian. One component required by such systems, and more broadly by most electronics systems employing the use of electromagnetic waves in general, is a device capable of directing the wave energy in a particular direction. In a radar system, for example, the beam frequently must be swept in azimuth and elevation, while the antenna in a communications system often must be directed toward a receiving unit.

Although steering devices adequate to handle the needs of conventional radars are known in the art, the recent trend toward the development of radar systems utilizing radio waves in the millimeter wavelength region has complicated the design of the beam steering function.

Millimeter wave active and passive radars possess an inherent allweather capability. Because of this feature, defense organizations have emphasized the development of millimeter wave systems for a number of major weapons systems. Millimeter wave radars have been contemplated, for example, for use in terminal guidance for mobile anti-tank, anti-aircraft, and air-to-surface projectile and missile systems, surface-to-air guidance and tracking, "smart" disposable warheads, and moving target identification and tracking. Particularly where such radars are designed for uses requiring a compact radar unit, such as on a ballistic missile, the small size of a millimeter wave antenna (due to the reduced wavelength as compared to conventional radars) is an additional attractive feature of the millimeter wave radar.

Conventional mechanical radar antenna sweeping systems, however, are inherently slow in response, relatively large in size, excessively heavy, and tend to be mechanically unstable, each of these attributes making these types of antennas unsuitable for use in the millimeter wave region missile radars. Furthermore, the discrete element phased array antennas used at longer (centimeter) wavelengths are not practical in the millimeter wavelength region because of the small physical dimensions, the large number of individual elements, and the exact tolerances which are there required. A ferromagnetic phased array, whether of the discrete element or space fed mosaic design, includes costly magnetic control coils in the antenna structure, and in addition is difficult to fabricate and tends to be less compact than is desired. Semiconductor diode phase shifters are limited in speed by carrier recombination time and require complicated structures for their implementation.

Consequently, a need has developed in the art for a beam steering device which is fast, reliable, relatively low in cost, compact, and light-weight in millimeter wavelength embodiments.

SUMMARY OF THE INVENTION

It is a general object of the invention to provide a new and improved device for steering an electromagnetic wave.

The phased array of the present invention includes a layer of active material, with first and second surfaces. A first array of electrodes is disposed on the first surface and in electrical contact with spaced regions of the first surface, while a first series of conductors each electrically contacts one electrode in the first array. A second array of electrodes is disposed on the second surface and in electrical contact with spaced regions of the second surface, while each one of a second series of conductors electrically contacts one electrode in the second array.

In another embodiment the phased array of the present invention includes adjacent first and second layers of active material, defining first and second inner and outer surfaces, respectively. A ground plane is disposed between the layers and in electrical contact with the inner surfaces. On each outer surface is disposed a series of electrodes in electrical contact with spaced regions of the surface.

In a more particular form the inner and outer surfaces of the layers are all parallel, while the electrodes of the first series are parallel to each other and are orthogonal to the electrodes of the second series, which are also parallel to one another.

Either of the above embodiments may further include antireflective coatings on the outer surfaces of the layers to increase the transmission efficiency of the array. In addition, specific materials for use as the active layers may be selected from the class of ferroelectric perovskites or from the class of ferroelectric tungsten bronzes.

The invention also embraces a method of deflecting an electromagnetic wave, which includes the steps of introducing a layer of either a ferroelectric perovskite or a ferroelectric tungsten bronze into the path of the wave, applying a voltage profile across the layer in the direction of wave travel, and adjusting the relative voltages across adjacent portions of the layer to introduce a surface of constant phase in the wave in a direction perpendicular to the desired direction of deflection.

In a more particular embodiment of the method, the latter step involves adjusting the relative voltages across adjacent vertical portions of the layer to introduce a surface of constant phase in the wave in a direction perpendicular to the vertical component of the desired direction of deflection. This embodiment includes the additional steps of introducing a second layer of a ferroelectric perovskite or a ferroelectric tungsten bronze into the path of the wave, applying a voltage profile across the second layer in the direction of wave travel, and adjusting the relative voltages across adjacent horizontal portions of the second layer to introduce a surface of constant phase in the wave in a direction perpendicular to the horizontal component of the desired direction of deflection.

These examples of the more important features of the invention have been broadly outlined in order to facilitate an understanding of the detailed description which follows and so that the contributions which this invention provides to the art may be better appreciated. There are, of course, additional features of the invention, which will be further described below and which are included within the subject matter of the appended claims.

BRIEF DESCRIPTION OF THE DRAWINGS

Additional objects, features, and advantages of the present invention will become apparent by referring to the detailed description of the preferred embodiments in connection with the accompanying drawings, wherein the same reference numerals refer to like elements throughout all the figures. In the drawings.

DESCRIPTION OF THE PREFERRED EMBODIMENT

Figure 1:
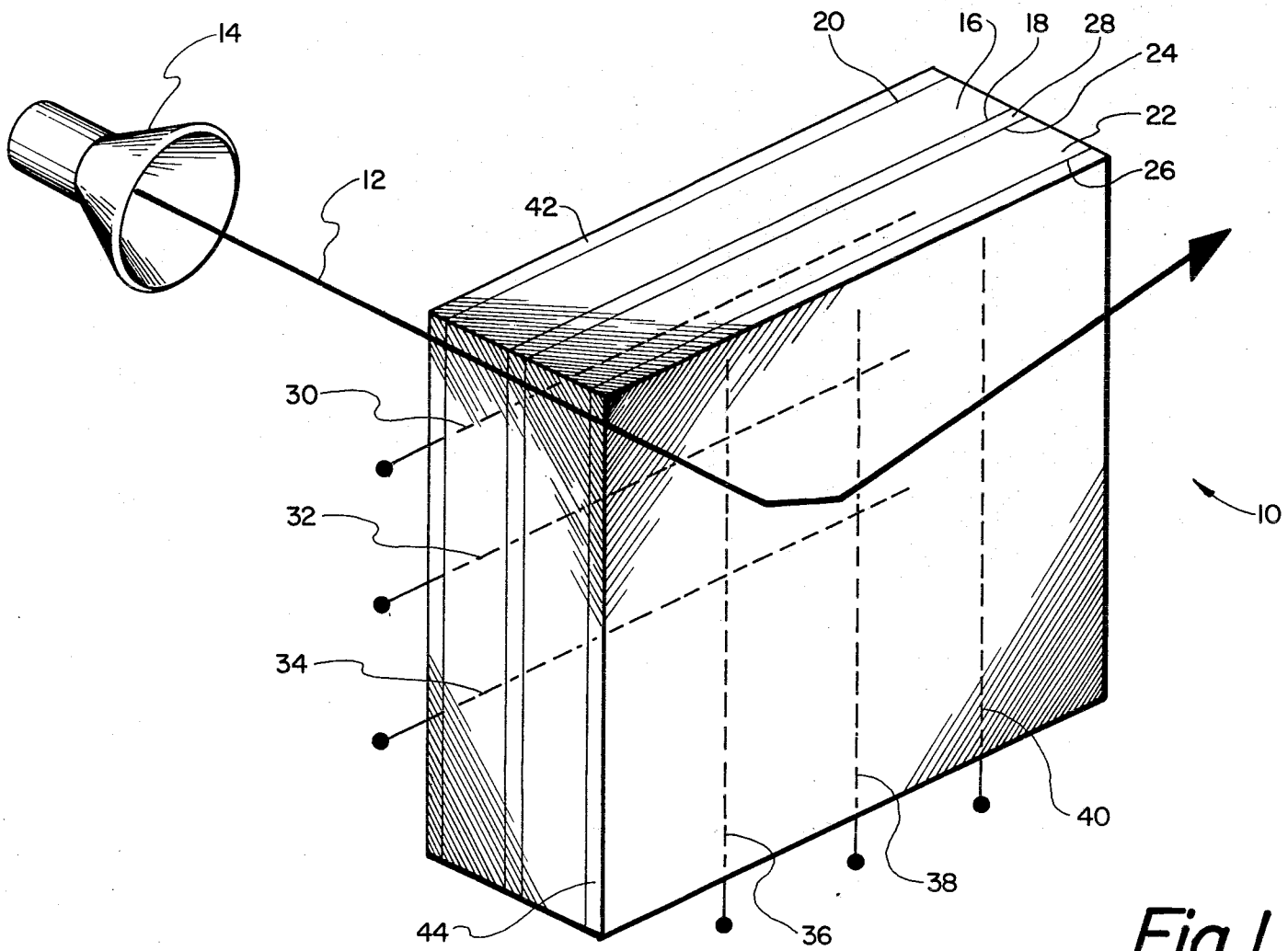
FIG. 1 is a perspective view of a phased array for steering an electromagnetic wave which is constructed according to the present invention.

FIG. 1 provides a perspective view of the presently preferred embodiment of our invention. This embodiment is particularly adapted for controlling the direction of a millimeter wave radar beam, although, as will be appreciated by those skilled in the art, the inventive concept may also be applied to advantage in applications for steering electromagnetic waves at other than millimeter wavelengths. In FIG. 1, a phased array 10 is illustrated deflecting a radar beam 12, which is space fed from a horn 14. The techniques and equipment necessary to generate a space fed radar beam are well known to those skilled in the art, hence there is no need to discuss those aspects of the system illustrated in any detail.

The phased array 10 includes a first layer 16 of active material, the layer 16 defining parallel first inner and outer surfaces 18 and 20. A second layer 22 of active material is positioned adjacent the first layer and defines parallel second inner and outer surface 24 and 26, which are also parallel to the first surfaces 18 and 20. In this context, the term "active material" is used to describe a material which will change the phase of an electromagnetic wave passing through it in response to an electric potential applied to the material. In the millimeter wave region, for example, we have found that the ferroelectric perovskites and the ferroelectric tungsten bronzes are good candidates for use as active materials in the array, as will be explained in more detail below.

Sandwiched between the first and second layers, and in electrical contact with the inner surfaces 18 and 24, is an electrically conductive ground plane 28 of indium tin oxide. A first series of spaced parallel electrodes 30, 32, and 34 is deposited on the first outer surface 20 of the first layer 16, while a second series of spaced parallel electrodes 36, 38, and 40 is deposited on the second outer surface 26 of the second layer 22 such that the electrodes in the second series are orthogonal to those in the first series. Each of the electrodes is a thin, transparent, electrically conductive strip of indium tin oxide which is in electrical contact with the surface on which it is deposited. While only a limited series of three electrodes is shown on each of the surfaces in FIG. 1, the drawing is depicted in this form merely for the purpose of clarifying the illustration. Those skilled in the art will appreciate that a practical array may include a much greater number of more closely spaced electrodes to accomplish the desired beam steering, as is explained in more detail below.

The structure of the array is completed by the application of a first antireflective coating 42 to the first outer surface 20 and a second antireflective coating 44 to the second outer surface 26.

It is an outstanding feature of this invention to provide a beam steering technique which applies the phenomenon of birefringence in exceptional regions of the electromagnetic spectrum, such as the millimeter wavelengths. It is well known that an electric field will induce birefringence in certain classes of materials. This effect, however, which is known as Pockel's effect, has been extensively examined only in the optical and near infrared regions of the spectrum. In the optical region, the magnitude of the voltage required to induce a 180° phase shift through birefringence, where the electric field is applied in the direction of the beam propagation, is:

$$V_{\frac{1}{2}}=\lambda/2[n_o^3 r] \quad (1)$$

where $\lambda$ is the wavelength, $n_o$ is the refractive index for the ordinary ray, and r is known as the linear electro-optic coefficient, defined as the change in the quantity $(1/n_o^2)$ per volt per meter of path length.

In the optical region, the values of $\lambda$ and $n_o^3 r$ for typical materials exhibiting a large electro-optic effect require a value for $V_{\frac{1}{2}}$ of approximately 100 Volts. Because of the thousandfold increase in wavelength in going to the millimeter wave region, equation (1) would lead to prohibitively large values of $V_{\frac{1}{2}}$ in that region for these same materials. Indeed, although there has been little experimental or theoretical work done on birefringent effects in the millimeter wave region, some data reported in 1971 for 58 GHz waves indicated discouragingly high values of $V_{\frac{1}{2}}$ of from $5\times10^4$ to $1\times10^6$ volts.

Although the teaching in the art has thus been less than encouraging, and no satisfactory predictive theory is available to extrapolate materials properties to the millimeter wave region, in certain classes of electro-optic materials exceedingly large values of the radio frequency index $n_o$ have been found, connected with the ferroelectric phase transition (the Curie temperature) which occurs in these materials near room temperature. In such materials, dielectric measurements at radio frequencies have indicated values of $n_o$ of approximately 100 or greater. We have reasoned that by simultaneously optimizing the dielectric properties and what may be denoted the electro-microwave properties (by analogy to the electro-optic effect in the optical region), it should be possible to adequately compensate for the thousandfold increase in wavelength of the millimeter region and thereby reduce $V_{\frac{1}{2}}$ to a reasonable value which is subject to practical implementation.

The most promising materials which fit these criteria are the ferroelectric perovskites and the ferroelectric tungsten bronzes. Preliminary measurements for strontium barium niobate ($Sr_xBa_{1-x}Nb_2O_6$) have been made at 60 GHz for $x=0.6$. A value for $V_{\frac{1}{2}}$ of approximately 5000 Volts has been measured, and optimization of materials properties should lead to further reductions in this voltage.

Figure 3:
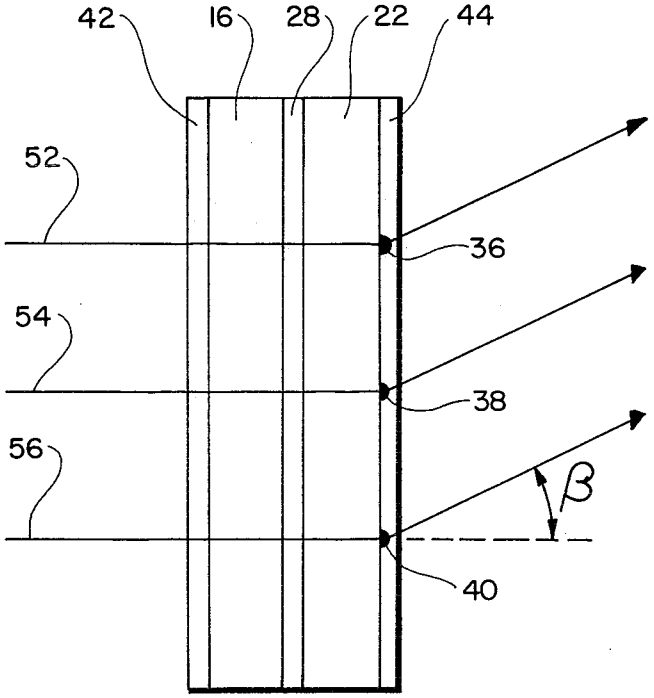
FIG. 3 is a top view of the array shown in FIG. 1.
Figure 2:
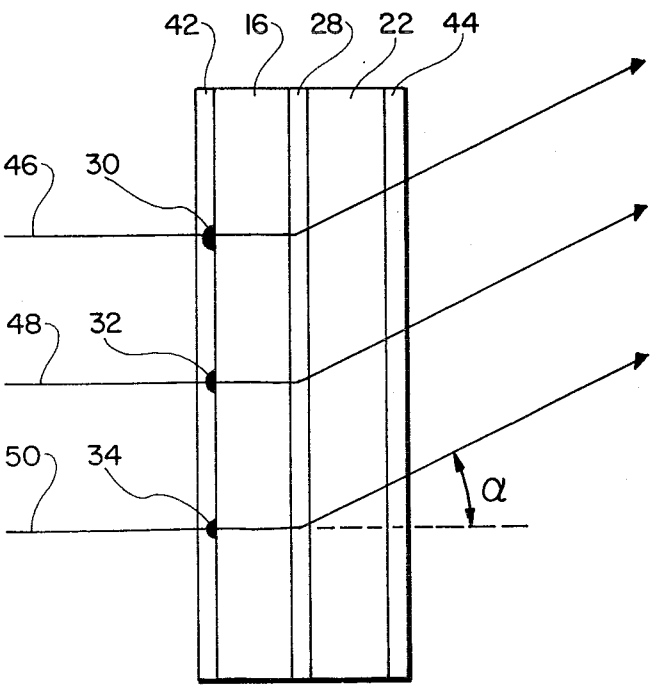
FIG. 2 is a side view of the array of FIG. 1.

With reference now to FIGS. 2 and 3, the operation of the phased array 10 can be explained as follows. Although the operation is more properly explained in terms of phase changes, the principles may be more clearly illustrated with ray-type diagrams, as is done in FIGS. 2 and 3. In FIG. 2, which is a side view of the array 10 of FIG. 1, the beam 12 is divided into three rays 46, 48, and 50. These rays pass through the antireflective coating 42 and into the first layer 16, where they are subjected to differing amounts of phase shift according to the electrical potentials which are applied between the ground plane 28 and the electrodes 30, 32, and 34, to cause a phase shift through the electro-microwave effect. These potentials may be applied, as will be understood by those skilled in the art, so that the phase profile at the ground plane 28 corresponds to a beam travelling at a desired angle $\alpha$ with respect to the incident direction. As a result, the beam is effectively deflected by the vertical angle $\alpha$ from its initial direction. FIG. 3 is a top view of the array 10 and illustrates a similar mode of operation to achieve steering in the horizontal direction. In FIG. 3, three rays 52, 54, and 56 pass through the first antireflective coating 42, through the first layer 16, through the ground plane 28, and into the second layer 22, where the rays are shifted in phase varying amounts according to the electrical potentials applied between the ground plane 28 and the electrodes 36, 38, and 40. These phase shifts result in a phase profile at the outer surface 40 corresponding to a beam travelling at a horizontal angle $\beta$ with respect to the incident directions. Thus the overall result of the operation of the phased array is to steer the beam away from its original direction by a vertical angle $\alpha$ and a horizontal angle $\beta$. Thus, if the voltage on the i th vertical electrode is denoted by $V_y(x_i)$ and voltage on the j th horizontal electrode is denoted by $V_x(y_j)$, then the total voltage on any element (ij) can be expressed as $V_y(x_i)-V_x(y_j)$. For linear variations in $V_y$ and $V_x$, a constant phase differential between adjacent elements can be achieved in any direction across the wavefront. As those skilled in the art will appreciate, and as mentioned earlier with respect to FIG. 1, an actual phased array constructed according to the present invention will contain a significantly larger number of more closely spaced electrodes in both the first and second series of electrodes, with spacing on the order of a half wavelength or less, to ensure that a beam may be steered efficiently by the array.

Figure 4:
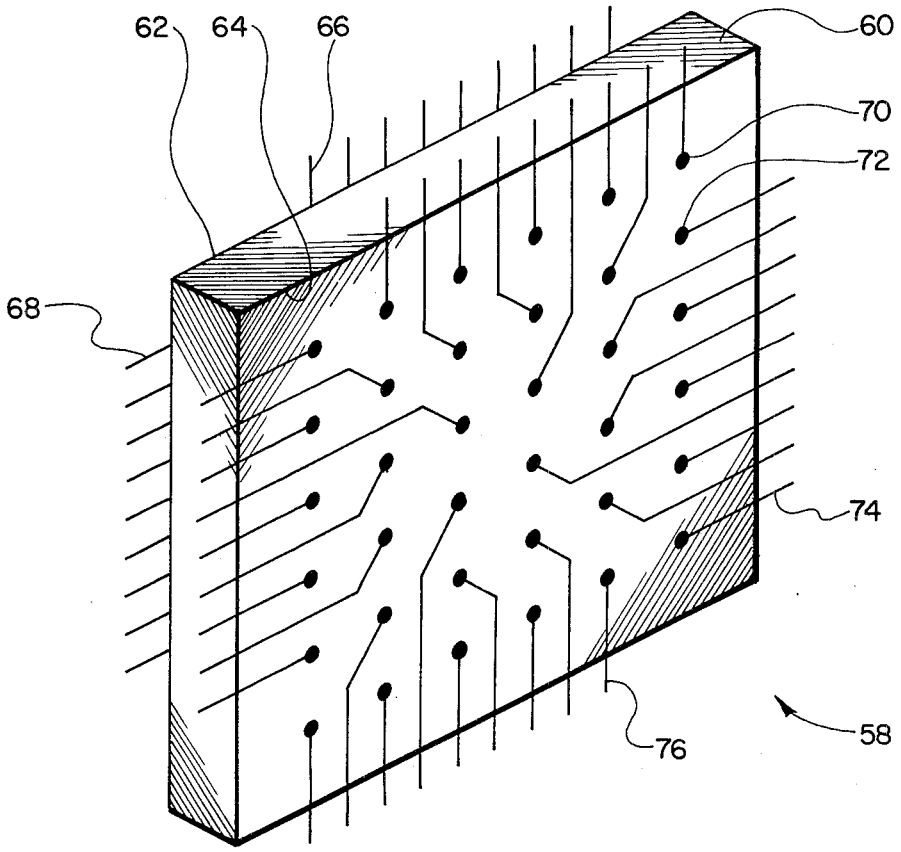
FIG. 4 is a perspective view of a second embodiment of the phased array of this invention.

FIG. 4 is an illustration, in a perspective view, of another embodiment of the present invention. The phased array 58 includes a layer 60 of an active material, which defines a first surface 62 and a second surface 64. A first array of point electrodes, which is not visible in the view illustrated in FIG. 4, is deposited on the first surface 62 and in electrical contact with regularly spaced regions of the first surface. A first series of conductors, such as, for example, the conductors 66 and 68, is disposed on the first surface such that the conductors each are electrically isolated from the surface but electrically contact one electrode in the first array and extend to an edge of the first surface. In a similar manner, a second array of point electrodes, including typical electrodes 70 and 72, is deposited on the second surface 64 and in electrical contact with regularly spaced regions of the second surface, while a second series of conductors, such as typical conductors 74 and 76, is disposed on the second surface such that each conductor is isolated from the surface and is in electrical contact with one electrode in the second array, extending to an edge of the second surface.

The embodiment of the array illustrated in FIG. 4 operates in a manner similar to that explained above in conjunction with FIGS. 2 and 3, except that the present embodiment is designed so that each of the electrodes can be individually addressed. With this capability, a particular voltage can be selected to be applied across each region of the layer 60, so that the desired vertical and horizontal components of the beam steering direction can be achieved within a single active layer. An actual array, of course, would tend to have a considerably greater number of more closely spaced electrodes. Although they are not illustrated here, those skilled in the art will appreciate that anti-reflective coatings, as illustrated in FIGS. 1-3, may also be applied to this embodiment to increase the transmission efficiency of the array.

The array of this invention exhibits major advantages over previously known array designs since the present array can be manufactured by microelectronic and thin film technology, offering the advantages of low cost, compact design, light weight, and highly accurate electrode spacing. Current technology is available to deposit submicron thickness indium tin oxide strips on layers of electrically active material with densities of approximately 200 lines per centimeter, so that the electrode spacing and accuracy necessary for millimeter waves can readily be achieved. Such strips will cause only a negligible loss to the propagating beam. The high inherent reflectivity of such electro-optic materials as potassium tantalate niobate in the air can be reduced by the use of standard multiple layer antireflection coatings, such as rutile, on each side of the array.

In conclusion, although typical embodiments of the present invention have been illustrated and discussed above, numerous modifications and alternative embodiments of the apparatus and method of this invention will be apparent to those skilled in the art in view of this description. Although the embodiments discussed are, for example, applicable for use with the millimeter wave region, the invention may also be applicable for steering beams from other regions of the electromagnetic spectrum. Accordingly, this description is to be considered as illustrative only and is provided for the purpose of teaching those skilled in the art the manner of constructing the apparatus and performing the method of this invention. Furthermore, it should be understood that the forms of the invention depicted and described herein are to be considered as the presently preferred embodiments. Various changes may be made in the configurations, sizes, and arrangements of the components of the invention, as will be recognized by those skilled in the art, without departing from the scope of the invention. Equivalent elements, for example, might be substituted for those illustrated and described herein, parts or connections might be reversed or otherwise interchanged, and certain features of the invention might be utilized independently of the use of other features, all as will be apparent to one skilled in the art after receiving the benefit attained through reading the above description of the invention.

What is claimed is:

1. A phased array for steering an electromagnetic wave, comprising:

a thin layer of active material having an $n_o^3r$ product of at least $10^{-5}$ meters per Volt at microwave frequencies where $n_o$ is the refractive index and r is the electro-optic coefficient of said material, said layer including first and second surfaces and defining a wave propagation direction therethrough;

a first array of thin film electrodes disposed on said first surface and in electrical contact with spaced regions of said first surface;

a first series of thin film conductors, each of said conductors electrically contacting one electrode in said first array;

a second array of thin film electrodes disposed on said second surface and in electrical contact with spaced regions of said second surface; and a second surface of thin film conductors, each of said conductors electrically contacting one electrode in said second array such that an electric potential applied to corresponding electrodes in said first and second arrays will create an electric field across said layer and parallel to said wave propagation direction.

2. The array of claim 1 wherein said first and second surfaces are parallel.

3. The array of claim 2, further comprising:

a first antireflective coating deposited on said first surface; and a second antireflective coating deposited on said second surface.

4. The array of claim 3 wherein said active material further comprises a ferroelectric perovskite.

5. The array of claim 3 wherein said active material further comprises a ferroelectric tungsten bronze.

6. A phased array for steering an electromagnetic wave, comprising:

a first layer of active material, including first inner and outer surfaces;

a second layer of active material, including second inner and outer surfaces, adjacent said first layer;

a ground plane disposed between said first and second layers and in electrical contact with said first and second inner surfaces;

a first series of electrodes disposed on said first outer surface and in electrical contact with spaced regions of said first outer surface; and a second series of electrodes disposed and said second outer surface and in electrical contact with spaced regions of said second outer surface.

7. The array of claim 6, wherein said first inner and outer surfaces are parallel and are parallel to said second inner and outer surfaces.

8. The array of claim 7, wherein said first series of electrodes comprises a series of spaced parallel electrodes; and said second series of electrodes comprises a series of spaced parallel electrodes orthogonal to said first series of electrodes.

9. The array of claim 8, wherein each of said electrodes further comprises a thin strip of indium tin oxide deposited on one of said outer surfaces.

10. The array of claim 9, wherein said ground plane further comprises a layer of indium tin oxide.

11. The array of claim 10, further comprising:

a first antireflective coating deposited on said first outer surface; and a second antireflective coating deposited on said second outer surface.

12. The array of claim 11, wherein said first and second layers comprise a ferroelectric perovskite.

13. The array of claim 11, wherein said first and second layers comprise a ferroelectric tungsten bronze.

14. A phase array for steering an electromagnetic wave, comprising:

a first layer of active material, including parallel first inner and outer surfaces;

a second layer of active material, including parallel second inner and outer surfaces which are also parallel to said first inner and outer surfaces, adjacent said first layer;

a ground plane of indium tin oxide disposed between said first and second layers and in electrical contact with said first and second inner surfaces;

a first series of spaced parallel electrodes, each of said electrodes comprising a thin strip of indium tin oxide deposited on and in electrical contact with said first outer surface;

a second series of spaced parallel electrodes, each of said electrodes comprising a thin strip of indium tin oxide, deposited on and in electrical contact with said second outer surface and orthogonal to said first series of electrodes;

a first antireflective coating deposited on said first outer surface; and a second antireflective coating deposited on said second outer surface.

15. A method of deflecting an electromagnetic wave, comprising the steps of:

(a) introducing into the path of the wave a thin layer of active material having an $n_o^3r$ product of at least $10^{-5}$ meters per Volt at microwave frequencies where $n_o$ is the refractive index and r is the electro-optic coefficient of the material;

(b) applying a voltage profile across the layer in the direction of wave travel; and (c) adjusting the relative voltages across adjacent portions of the layer to introduce a surface of constant phase in the wave in a direction perpendicular to the desired deflection direction.

16. The method of claim 15, wherein the thin layer of active material comprises a ferroelectric perovskite.

17. The method of claim 15, wherein the thin layer of active material comprises a ferroelectric tungsten bronze.

18. The method of claim 16, wherein step (c) further comprises the step of adjusting the relative voltages across adjacent vertical portions of the layer to introduce a constant phase profile in the wave in a direction perpendicular to the vertical component of the desired deflection direction; and the method further comprises the steps of (d) introducing a second layer of a ferroelectric perovskite into the path of the wave;

(e) applying a voltage profile across the second layer in the direction of wave travel; and (f) adjusting the relative voltages across adjacent horizontal portions of the second layer to introduce a surface of constant phase in the wave in a direction perpendicular to the horizontal component of the desired deflection direction.

19. The method of claim 17, wherein step (c) further comprises the step of adjusting the relative voltages across adjacent vertical portions of the layer to introduce a constant phase profile in the wave in a direction perpendicular to the vertical component of the desired deflection direction, and the method further comprises the steps of (d) introducing a second layer of a ferroelectric tungsten bronze into the path of the wave;

(e) applying a voltage profile across the second layer in the direction of wave travel; and (f) adjusting the relative voltages across adjacent horizontal portions of the second layer to introduce a surface of constant phase in the wave in a direction perpendicular to the horizontal component of the desired deflection direction.

* * * * *